US012000321B1

(12) United States Patent
Wilks

(10) Patent No.: US 12,000,321 B1
(45) Date of Patent: Jun. 4, 2024

(54) SYSTEMS AND METHODS TO REDUCE METHANE EMISSIONS ASSOCIATED WITH A LEAN-BURN NATURAL GAS ENGINE

(71) Applicant: Caterpillar Inc., Peoria, IL (US)

(72) Inventor: Zachary J. Wilks, Spring, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/172,930

(22) Filed: Feb. 22, 2023

(51) Int. Cl.
*F01N 3/24* (2006.01)
*F01N 3/20* (2006.01)
*F01N 5/02* (2006.01)

(52) U.S. Cl.
CPC ..... *F01N 3/24* (2013.01); *F01N 3/2013* (2013.01); *F01N 5/025* (2013.01); *F01N 2260/02* (2013.01)

(58) Field of Classification Search
CPC ..... F01N 3/24; F01N 3/2013; F01N 5/025; F01N 2260/02
See application file for complete search history.

(56) References Cited

U.S. PATENT DOCUMENTS

| | | | | |
|---|---|---|---|---|
| 10,577,883 | B2 | 3/2020 | Etter et al. | |
| 10,995,652 | B1 * | 5/2021 | Han | F01P 3/12 |
| 11,426,703 | B2 | 8/2022 | Norris et al. | |
| 2017/0173531 | A1 | 6/2017 | Williams et al. | |
| 2018/0142595 | A1 * | 5/2018 | Cook | G01R 31/367 |
| 2020/0102874 | A1 * | 4/2020 | Kurtz | F02D 41/1441 |
| 2020/0131959 | A1 * | 4/2020 | Baron Von Ceumern-Lindenstjerna | F02D 41/008 |
| 2020/0191020 | A1 * | 6/2020 | Delahanty | F01P 5/10 |
| 2022/0395777 | A1 * | 12/2022 | Caravaggio | B01J 35/1019 |

FOREIGN PATENT DOCUMENTS

| | | | |
|---|---|---|---|
| WO | 2012013235 | A1 | 2/2012 |
| WO | WO-2020074267 | A1 * | 4/2020 |
| WO | 2022178188 | A1 | 8/2022 |
| WO | 2022180375 | A1 | 9/2022 |

OTHER PUBLICATIONS

Machine Translation of WO-2020074267-A1 (Year: 2020).*

* cited by examiner

*Primary Examiner* — Brandon D Lee
(74) *Attorney, Agent, or Firm* — Harrity & Harrity, LLP

(57) ABSTRACT

An engine system includes a lean-burn natural gas engine, an electric power supply component, an aftertreatment housing, and a heating component within the aftertreatment housing. The lean-burn natural gas engine provides, when in operation, an exhaust gas that includes methane to an input end of the aftertreatment housing. The aftertreatment housing allows the exhaust gas to flow through the aftertreatment housing from the input end of the aftertreatment housing to an output end of the aftertreatment housing. The electric power supply component provides, to the heating component, electric power that is generated using one or more low-carbon generation techniques. The heating component generates, based on the electric power provided by the electric power supply component, heat, and provides the heat within the aftertreatment housing. This causes a percentage of methane in the exhaust gas that flows through the aftertreatment housing to be reduced.

20 Claims, 4 Drawing Sheets

SYSTEMS AND METHODS TO REDUCE METHANE EMISSIONS ASSOCIATED WITH A LEAN-BURN NATURAL GAS ENGINE

TECHNICAL FIELD

The present disclosure relates generally to lean-burn natural gas engines and, for example, to reducing methane emissions associated with a lean-burn natural gas engine.

BACKGROUND

Natural gas engines, including lean-burn natural gas engines, are used for various applications, such as for natural gas compression, storage, pipeline transmission, and other similar applications. A lean-burn natural gas engine is an internal combustion engine that employs a higher air-to-fuel ratio than a typical natural gas engine. The excess air absorbs heat during a combustion process of the lean-burn natural gas engine, which serves to reduce the temperature associated with the combustion process. This greatly reduces levels of unwanted emissions, such as nitrogen oxides (often referred to as "NOx"), in an exhaust gas produced by the combustion process. However, the cooler combustion process results in a reduced temperature of the exhaust gas, which prevents a typical conversion process (e.g., that requires the temperature of the exhaust gas to be greater than or equal to a threshold temperature, such as 500 degrees (°) Celsius (C)) being employed to reduce the percentage of methane, another unwanted emission, in the exhaust gas.

In some cases, to increase the temperature of the exhaust gas, the air-to-fuel ratio can be decreased (e.g., by increasing an amount of natural gas). This increases the temperature of the combustion process, and can allow the exhaust gas to become hot enough to enable a typical conversion process. However, because the amount of natural gas is increased to enable a higher temperature combustion process, this approach has the downside of reducing fuel efficiency and increasing other unwanted emissions (e.g., due to the increased amount of natural gas and the higher temperature combustion process), such as NOx. Alternatively, a heating component or accelerant can be employed to heat the exhaust gas (e.g., to be greater than or equal to the threshold temperature) to enable the conversion process. But, the heating component or accelerant is typically powered by a source that generates carbon dioxide emissions (e.g., based on burning a fossil fuel or other high-carbon fuel). This therefore produces additional unwanted emissions (e.g., additional NOx). Due to increased awareness of an environmental impact of unwanted emissions, it is typically preferred to reduce methane emissions of a lean-burn natural gas engine without producing additional unwanted emissions (e.g., without producing additional carbon dioxide or NOx).

The present disclosure is directed to solving one or more of the problems set forth above and/or other problems in the art.

SUMMARY

A system may include a lean-burn natural gas engine; an electric power supply component; an aftertreatment housing; and a heating component within the aftertreatment housing wherein: the lean-burn natural gas engine is configured to provide, when in operation, an exhaust gas that includes methane to an input end of the aftertreatment housing, the aftertreatment housing is configured to allow the exhaust gas to flow through the aftertreatment housing from the input end of the aftertreatment housing to an output end of the aftertreatment housing, the electric power supply component is configured to provide, to the heating component, electric power that is generated using one or more low-carbon generation techniques, and the heating component is configured to: generate, based on the electric power provided by the electric power supply, heat, and provide the heat within the aftertreatment housing.

A system may include an electric power supply component; an aftertreatment housing; and a heating component within the aftertreatment housing wherein: the aftertreatment housing is configured to allow exhaust gas that includes methane to flow through the aftertreatment housing from an input end of the aftertreatment housing to an output end of the aftertreatment housing, the electric power supply component is configured to provide, to the heating component, electric power that is generated using one or more low-carbon generation techniques, and the heating component is configured to generate, based on the electric power provided by the electric power supply, heat within the aftertreatment housing.

A system may include an electric power supply component; and a heating component within an aftertreatment housing wherein: the electric power supply component is configured to provide, to the heating component, electric power that is generated using one or more low-carbon generation techniques, and the heating component is configured to generate, based on the electric power provided by the electric power supply, heat within the aftertreatment housing to cause an amount of methane in an exhaust gas that flows through the aftertreatment housing to be reduced.

DETAILED DESCRIPTION

This disclosure relates to a systems and methods to reduce methane emissions associated with a lean-burn natural gas engine, but is applicable to any internal combustion engine (e.g., any lean burn internal combustion engine), turbine, boiler, furnace, or industrial process that produces exhaust gas that includes methane.

Figure 1:
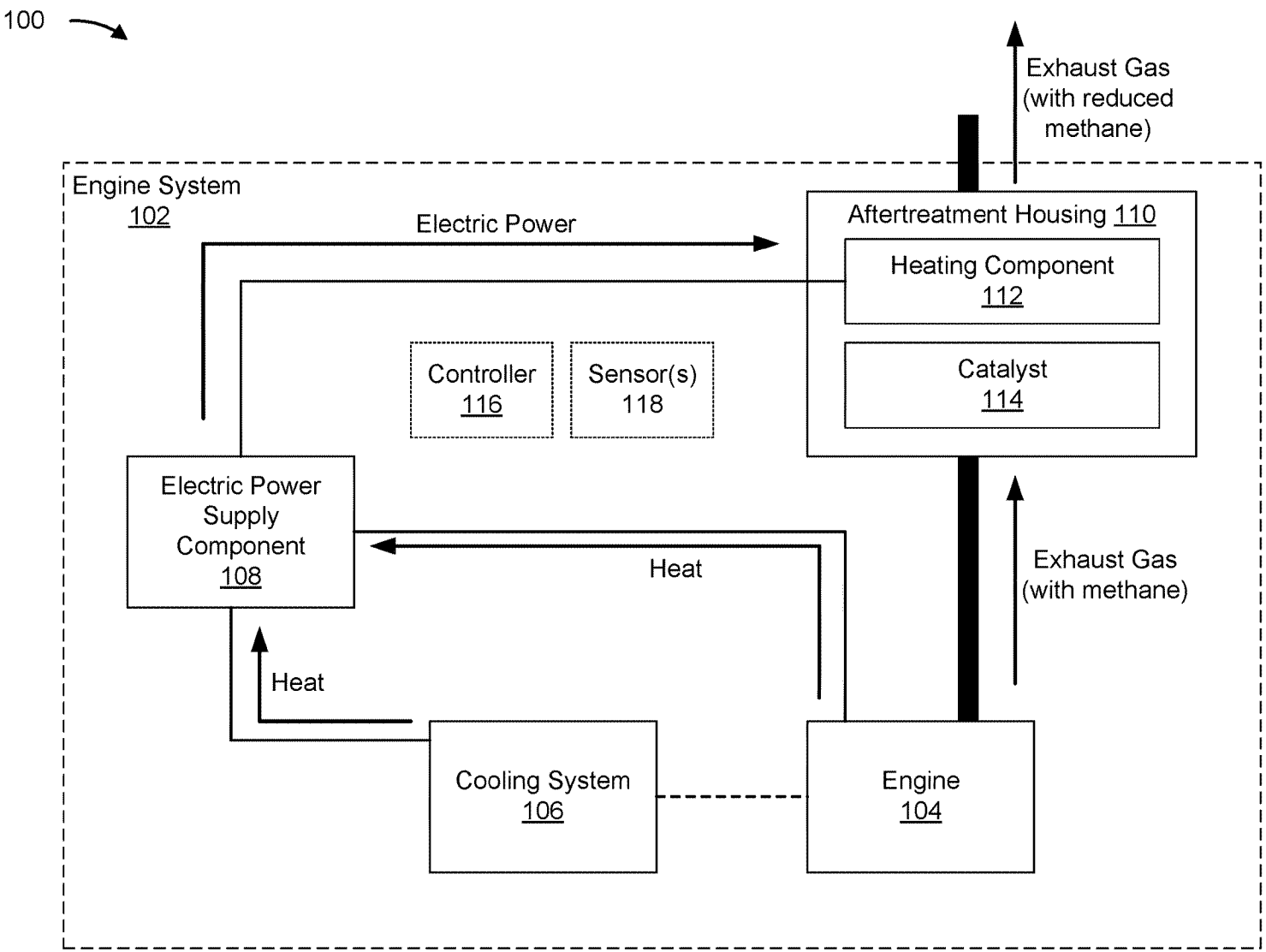
FIG. 1 is a diagram of an example implementation described herein.

FIG. 1 is a diagram of an example implementation 100 described herein. As shown in FIG. 1, the implementation 100 may include an engine system 102, which may comprise an engine 104, a cooling system 106, an electric power supply component 108, an aftertreatment housing 110 (e.g., that includes a heating component 112 and/or a catalyst 114), a controller 116, and/or one or more sensors 118. The engine system 102 (and the one or more components of the engine system 102, such as the engine 104) may be used in association with one or more applications, such as natural gas compression, storage, pipeline transmission, and/or similar applications. In some implementations, the engine system 102 may be associated with a machine (e.g., a work machine), a vehicle, generator, mobile machinery, stationary machinery, general industrial equipment, or any other machine or equipment.

The engine 104 may be an internal combustion engine, such as a lean-burn internal combustion engine (e.g., an internal combustion engine that utilizes a lean air-to-fuel ratio, such as an air-to-fuel ratio that is greater than or equal to 1.5). For example, the engine 104 may be a lean-burn natural gas engine (e.g., that utilizes an air-to-natural gas ratio that is greater than or equal to 1.5). The engine 104, when in operation, may be configured to ignite a mixture of air and fuel (e.g., natural gas) within a combustion chamber of the engine 104, which generates an exhaust gas. When the engine 104 is a powered by natural gas, such as a lean-burn natural gas engine, the exhaust gas may include methane.

As shown in FIG. 1, the engine 104 may be connected (e.g., fluidly connected) to the aftertreatment housing 110. Accordingly, the engine 104 may provide the exhaust gas (e.g., that includes methane) to the aftertreatment housing 110. For example, as shown in FIG. 1, the engine 104 may provide the exhaust gas to an input end of the aftertreatment housing 110. The aftertreatment housing 110 may be configured to allow the exhaust gas to flow through the aftertreatment housing 110 (e.g., within an internal environment of the aftertreatment housing 110), such as from the input end of the aftertreatment housing 110 to an output end of the aftertreatment housing 110. This may enable a conversion process, as further described herein, that reduces a percentage of methane in the exhaust gas. Accordingly, a percentage of methane in the exhaust gas after the exhaust gas exits the aftertreatment housing 110 (e.g., to an external environment via the output end of the aftertreatment housing 110) may be less than a percentage of methane in the exhaust gas before the exhaust gas enters the aftertreatment housing 110 (e.g., via the input end of the aftertreatment housing 110).

As further shown in FIG. 1, the cooling system 106 may be associated with the engine 104. For example, the cooling system 106 may be configured to cool the engine 104 (e.g., when the engine 104 is in operation). In this way, the cooling system 106 may draw heat generated by operation of the engine 104 away from the engine 104.

The cooling system 106 may include one or more cooling components (not shown in FIG. 1). The one or more cooling components may include, for example, one or more cooling bladders, one or more pumps, one or more fans, one or more radiators, and/or one or more tanks for holding a coolant (e.g., that comprises, water, oil, a mixture that includes water and/or oil, or another type of coolant). The one or more cooling components may facilitate cooling of the engine 104 when the one or more cooling components are enabled (e.g., turned on or otherwise activated to provide a cooling functionality). In contrast, the one or more cooling components may not facilitate cooling of the engine 104 when the one or more cooling components are disabled (e.g., turned off or otherwise deactivated). In some implementations, the cooling system 106 may be configured to cool one or more other components of the engine system 102 (e.g., in addition to, or instead of, the engine 104).

As further shown in FIG. 1, the electric power supply component 108 may be associated with the engine 104, the cooling system 106, and/or the heating component 112. The electric power supply component 108 may be configured to provide electrical power, such as to the heating component 112. In some implementations, the electric power supply component 108 may be configured to generate the electric power using one or more low-carbon generation techniques (e.g., that do not rely on combustion of fossil fuels or other high-carbon fuels). For example, the electric power supply component 108 may be configured to generate (e.g., using a thermoelectric generation technique) the electric power based on heat generated by the engine 104 (e.g., as a result of operation of the engine 104). Accordingly, the electric power supply component 108 may include one or more thermoelectric generators (e.g., to generate the electric power based on the heat). As further shown in FIG. 1, the heat may be provided to the electric power supply component 108 directly via the engine 104 (e.g., because the electric power supply component 108 is within a threshold distance of the engine 104 to directly obtain the heat from the engine 104) and/or indirectly via the cooling system 106 (e.g., because the electric power supply component 108 is within a threshold distance of the cooling system 106 to obtain the heat from the cooling system 106 after the cooling system 106 draws the heat away from the engine 104).

As further shown in FIG. 1, the heating component 112 and the catalyst 114 may be disposed within the aftertreatment housing 110 (e.g., within the internal environment of the aftertreatment housing 110). The heating component 112 may be configured to generate (e.g., based on the electric power provided by the electric power supply component 108) heat (e.g., a different heat than that generated by the engine 104). For example, the heating component 112 may be an electrically driven heater element. The catalyst 114 may be configured to facilitate conversion of methane (e.g., in the exhaust gas), such as to water and/or carbon dioxide, as part of a conversion process described further herein. The catalyst 114 may include palladium, copper, silica, and/or one or more other elements or materials.

The heating component 112 may provide the heat (e.g., that the heating component 112 generated based on the electric power provided by the electric power supply component 108) within the aftertreatment housing 110. This may cause a temperature associated with the internal environment of the aftertreatment housing 110 to satisfy (e.g., be greater than) a temperature threshold. The temperature threshold may be associated with, for example, enabling a conversion process that reduces methane emissions of the exhaust gas (e.g., by reducing a percentage of methane in the exhaust gas). When the internal environment of the aftertreatment housing 110 satisfies the temperature threshold, conditions within aftertreatment housing 110 may allow the conversion process to occur, such as by allowing the methane within the exhaust gas to react with the catalyst 114. This may therefore cause a percentage of methane in the exhaust gas (e.g., that flows through the aftertreatment housing 110) to be reduced. The temperature threshold may be, for example, greater than or equal to 5000 C, 525° C., 5500 C, 575° C., 6000 C, 625° C., 6500 C, 675° C., or 700° C.

In some implementations, the heating component 112 providing the heat within the aftertreatment housing 110 may cause a temperature associated with exhaust gas to increase within the aftertreatment housing 110 (e.g., as the exhaust gas flows through the aftertreatment housing 110 from the input end to the output end of the aftertreatment housing 110), and/or may cause a temperature associated with the catalyst 114 to increase. For example, the heating component 112 providing the heat may cause at least one of the temperature associated with the exhaust gas or the temperature associated with the catalyst 114 to satisfy the temperature threshold (e.g., that is associated with enabling the conversion process, as described above). This may further facilitate the conversion process and thereby cause the percentage of methane in the exhaust gas to be further reduced.

As mentioned above, the heat generated by the engine 104 (e.g., a first heat) may be different than a heat (e.g., a second heat) generated by the heating component 112. For example, a first temperature associated with the first heat may be less than a second temperature associated with the second heat. Accordingly, the electric power supply component 108 may be configured to convert a "cooler" heat (e.g., the first heat) to electric power to allow the heating component 112 to generate and provide a "hotter" heat (e.g., the second heat), which may be used to facilitate a conversion process to reduce methane emissions in an exhaust gas.

The controller 116 may be an electronic control module (ECM) or other computing device. The controller 116 may be in communication (e.g., by a wired connection or a wireless connection) with the electric power supply component 108, the heating component 112, and/or the one or more sensors 118. The controller 116 may also be in communication with other components and/or systems of the engine system 102. The controller 116 may be configured to control the electric power supply component 108, the heating component 112, and/or the one or more sensors 118, as described herein (e.g., by generating and sending commands to the electric power supply component 108, the heating component 112, and/or the one or more sensors 118).

The one or more of sensors 118 may be installed at one or more points on the engine system 102 and may be configured to generate sensor data. For example, the one or more of sensors 118 may include one or more sensors configured to detect, during operation of the engine 104, one or more temperatures associated with a heat generated by the engine 104 (e.g., that is provided to the electric power supply component 108 by the engine 104 and/or the cooling system 106), a temperature of a heat generated by the heating component 112, a temperature associated with the internal environment of the heating component 112, one or more temperatures associated with the exhaust gas (e.g., at the input end of the aftertreatment housing 110, at the output end of the aftertreatment housing 110, and/or at one or more other positions within the aftertreatment housing 110), and/or a temperature associated with the catalyst 114, among other examples.

The controller 116 may control when the electric power supply component 108 generates and/or provides electric power (e.g., to the heating component 112) and/or when the heating component 112 generates and provides heat (e.g., within the aftertreatment housing 110) as part of a control process.

As part of the control process, the controller 116 may determine whether the engine 104 is operating and/or generating heat. For example, the controller 116 may communicate with the engine 104, the cooling system 106, and/or the one or more sensors 118 to determine whether the engine 104 is operating and/or generating heat.

The controller 116 may determine whether to enable the electric power supply component 108 (e.g., to allow the electric power supply component 108 to generate and/or provide electric power to the heating component 112). For example, the controller 116 may determine (e.g., based on determining that the engine 104 is not operating) that the electric power supply component 108 is not to be enabled (e.g., because the engine 104 is not operating and therefore not producing heat that the electric power supply component 108 can use to convert to electric power). As an alternative example, the controller 116 may determine (e.g., based on determining that the engine 104 is operating and generating heat) that the electric power supply component 108 is to be enabled (e.g., because the engine 104 is operating and therefore producing heat that the electric power supply component 108 can use to convert to electric power).

Accordingly, the controller 116 may cause the electric power supply component 108 to be enabled (e.g., based on determining that the electric power supply component 108 is to be enabled). This may cause the electric power supply component 108 to operate and thereby generate electric power (e.g., based on the heat generated by the engine 104 and provided to the electric power supply component 108 by the engine 104 and/or the cooling system 106). The electric power supply component 108 may provide the electric power to the heating component 112.

As further part of the control process, the controller 116 may determine whether to enable the heating component 112 (e.g., to allow the heating component 112 to generate, based on the electric power, heat and to provide the heat within the aftertreatment housing 110). For example, the controller 116 may communicate with the heating component 112 and/or the one or more sensors 118 to determine whether the temperature threshold (e.g., that is associated with enabling a conversion process for reducing a percentage of methane in the exhaust gas that flows through the aftertreatment housing 110) is satisfied by at least one of: the temperature of a heat generated by the heating component 112, the temperature associated with the internal environment of the heating component 112, the one or more temperatures associated with the exhaust gas (e.g., at the input end of the aftertreatment housing 110, at the output end of the aftertreatment housing 110, and/or at one or more other positions within the aftertreatment housing 110), and/or the temperature associated with the catalyst 114.

The controller 116 may determine (e.g., based on determining that the temperature threshold is not satisfied) that the heating component 112 is to be enabled (e.g., because one or more temperatures are not high enough to enable the conversion process). Accordingly, the controller 116 may cause the heating component 112 to operate and thereby cause the heating component 112 to generate and provide heat within the aftertreatment housing 110 (e.g., to enable the conversion process and thereby reduce a percentage of methane in the exhaust gas). Alternatively, the controller 116 may determine (e.g., based on determining that the temperature threshold is satisfied) that the heating component 112 is not to be enabled (e.g., because one or more temperatures are high enough to enable the conversion process). Accordingly, the controller 116 may cause the heating component 112 not to operate (e.g., to cease generating and providing heat within the heating component 112). In this way, the controller 116 reduces an amount of the electric power that is consumed by the heating component 112 and/or reduces a likelihood that unnecessary heat is generated within the heating component 112, which may prolong an operable life of the heating component 112, the catalyst 114, and/or the aftertreatment housing 110.

As indicated above, FIG. 1 is provided as an example. Other examples may differ from what is described with regard to FIG. 1.

Figure 2:
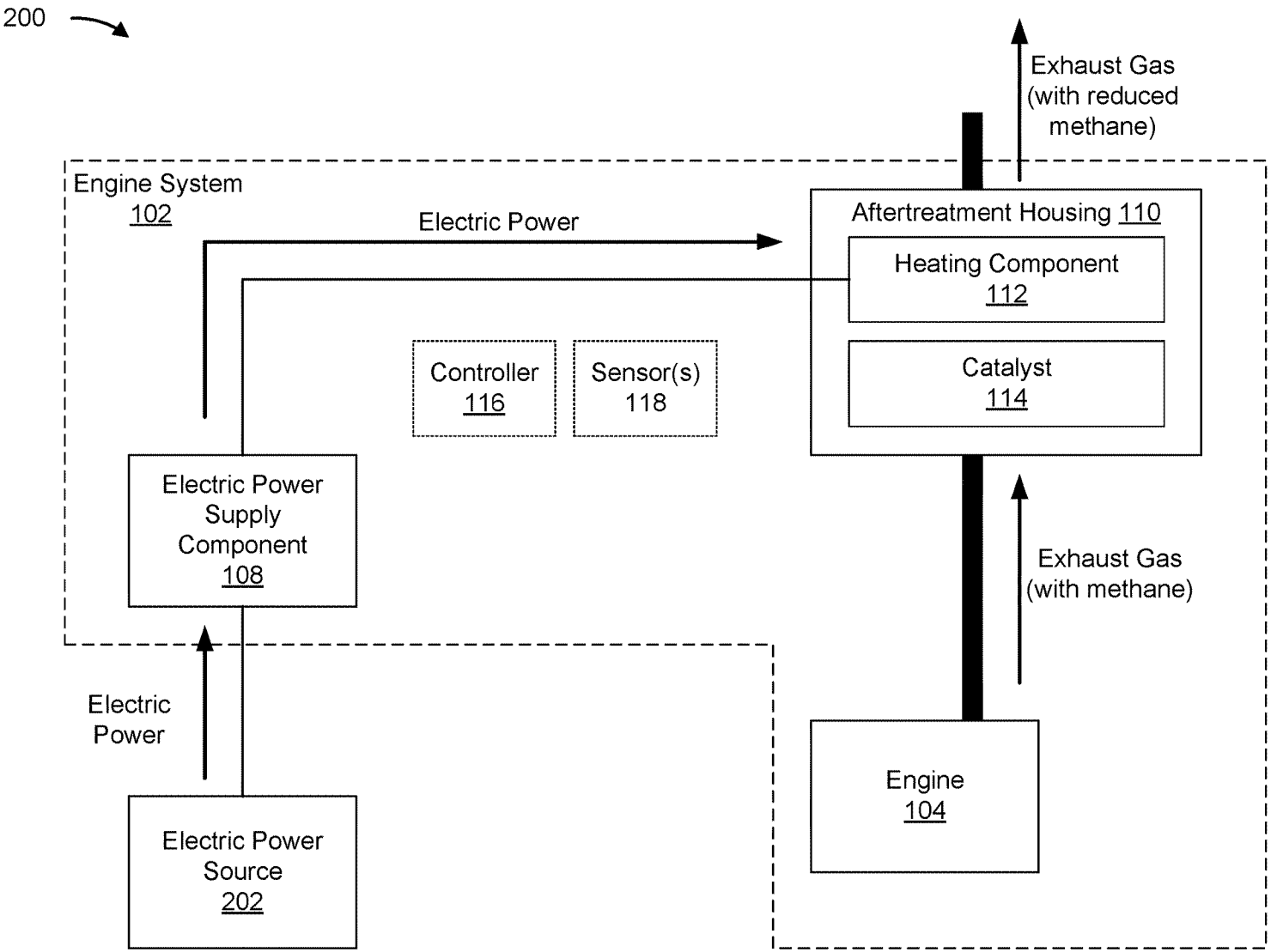
FIG. 2 is a diagram of an example implementation described herein.

FIG. 2 is a diagram of an example implementation 200 described herein. As shown in FIG. 2, the implementation 200 may include another configuration of the engine system 102.

As further shown in FIG. 2, an electric power source 202 (e.g., that is external to the engine system 102) may be configured to provide electric power to the electric power supply component 108, which may be configured to provide the electric power to the heating component 112 (as described elsewhere herein). In this way, the electric power supply component 108 may not need to generate the electrical power.

The electric power source 202 may generate the electric power using one or more low-carbon generation techniques. The one or more low-carbon generation techniques do not rely on combustion of fossil fuels or other high-carbon fuels, and are often referred to as "clean energy" generation techniques, "green energy" generation techniques, or other similar techniques. The one or more low-carbon generation techniques include a thermoelectric generation technique, a hydroelectric generation technique, a wind power generation technique, a solar power generation technique, a geothermal power generation technique, and/or a nuclear power generation technique, among other examples. For example, the electric power source 202 may be co-located with the engine system 102 at a worksite and may be configured to generate the electric power based on one or more environmental conditions of the worksite (e.g., to generate the electric power using a solar power generation technique when the worksite is associated with a solar energy source, using a wind power generation technique when the worksite is associated with a wind energy source, and/or the like). As another example, the electric power source 202 may be an electrical utility provider that generates electric power using the one or more low-carbon generation techniques (e.g., an electrical utility provider that generates electrical power using a hydroelectric generation technique, a geothermal power generation technique, and/or a nuclear power generation technique, among other examples). In some implementations, the electric power source 202 may generate the electric power using multiple low-carbon generation techniques, simultaneously (e.g., simultaneous generation of electric power using a solar power generation technique in combination with a wind power generation technique, simultaneous generation of electric power using a solar power generation technique and/or a wind power generation technique in combination with electric power from an electrical utility provider, and/or simultaneous generation of electric power from one or more sources that are co-located with the engine system 102 at a worksite in combination with electric power from one or more sources that are remote from the engine system 102 at the worksite, among other examples).

In some implementations, such as when using one or more low-carbon generation techniques is not available, the electrical power source 202 may generate the electric power using one or more other techniques (e.g., that may include one or more high-carbon generation techniques). For example, the electric power source 202 may be an engine-powered generator (e.g., that consumes a fossil fuel) or an auxiliary alternator of the engine 104 (e.g., that requires additional consumption of natural gas to operate) that is configured to generate the electric power.

The electric power source 202 may provide the electric power to the electric power supply component 108. In some implementations, the electric power supply component 108 may include storage to store the electric power (e.g., when the electric power supply component 108 is not actively providing the electric power to the heating component 112). For example, the electric power supply component 108 may include one or more batteries, such as one or more lithium-ion (Li-ion) batteries, lithium-ion polymer batteries, nickel-metal hydride (NiMH) batteries, lead-acid batteries, nickel cadmium (Ni—Cd) batteries, zinc-air batteries, sodium-nickel chloride batteries, or other types of batteries. In some implementations, multiple battery cells may be grouped together, in series or in parallel, within a battery module. Multiple battery modules may be grouped together, such as in series, within a battery string. One or more battery strings may be provided within a battery pack, such as a group of battery strings linked together in parallel. Accordingly, the electric power supply component 108 may include one or more battery packs, one or more battery strings, one or more battery modules, and/or one or more battery cells.

As part of the control process described above, the controller 116 therefore may determine whether to enable the electric power supply component 108 to allow the electric power supply component 108 to provide the electric power (e.g., that is generated by the electric power source 202) to the heating component 112. For example, the controller 116 may communicate with the electric power supply component 108 and/or the one or more sensors 118 to determine a state of charge (SoC) of the one or more batteries included in the electric power supply component 108. The controller 116 may determine that the electric power supply component 108 is to be enabled, such as when the SoC of the one or more batteries satisfies (e.g., is greater than or equal to) a battery charge percentage threshold (e.g., that may be less than or equal to 1%, 5%, 10%, 15%, or 20%, among other examples). Accordingly, the controller 116 may cause the electric power supply component 108 to be enabled, which causes the electric power supply component 108 to operate and provide the electric power to the heating component 112. Alternatively, the controller 116 may determine that the electric power supply component 108 is not to be enabled, such as when the SoC of the one or more batteries does not satisfy the battery charge percentage threshold. The controller 116 may therefore cause the electric power supply component 108 to be disabled to prevent the electric power supply component 108 from providing the electric power to the heating component 112 (and to allow the one or more batteries to be charged by the electric power generated by the electric power source 202).

As indicated above, FIG. 2 is provided as an example. Other examples may differ from what is described with regard to FIG. 2.

Figure 3:
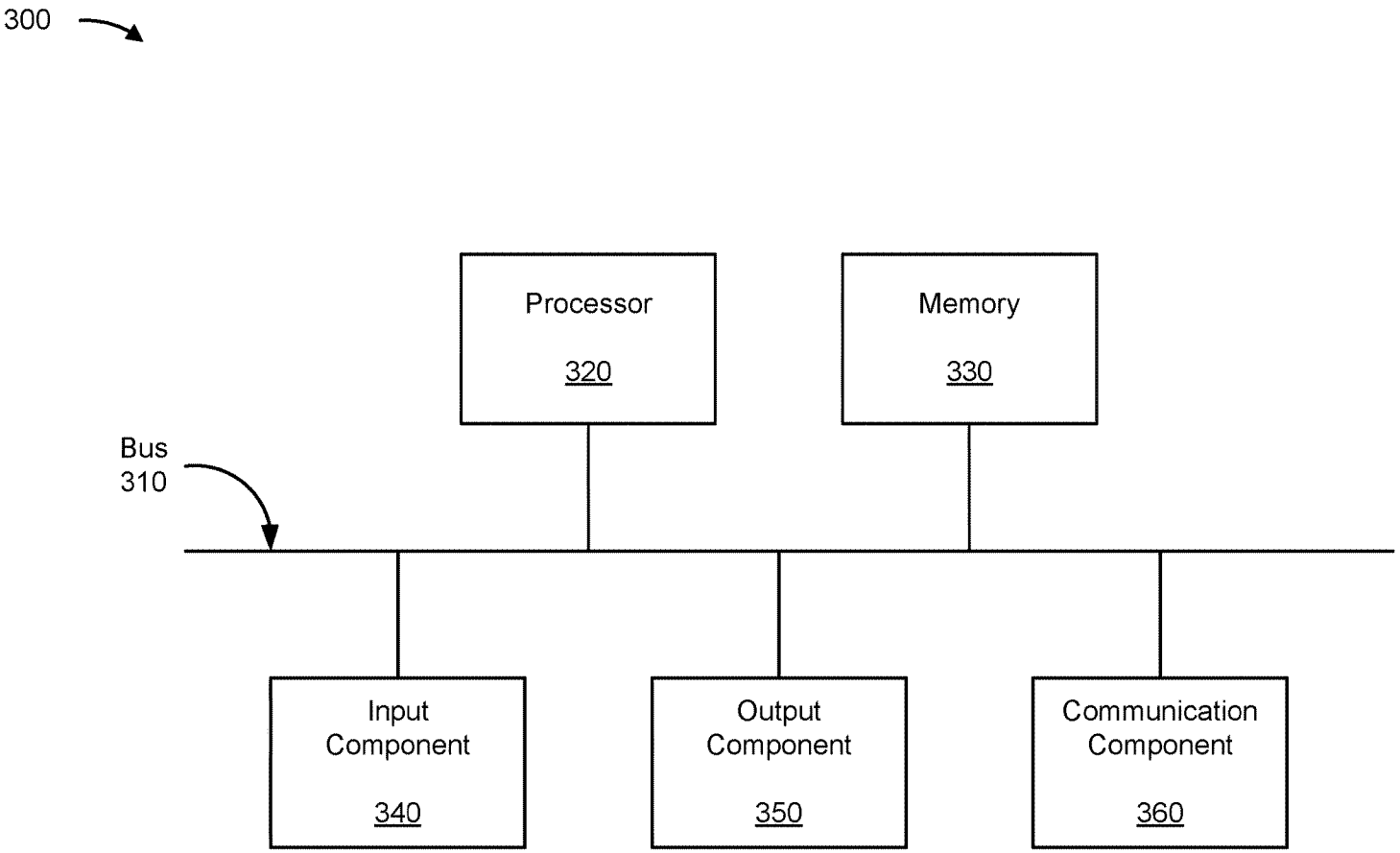
FIG. 3 is a diagram of example components of a device described herein.

FIG. 3 is a diagram of example components of a device 300 described herein. The device 300 may correspond to the controller 116, the one or more sensors 118, and/or one or more other components of the engine system 102 and/or the electric power source 202. In some implementations, the controller 116, the one or more sensors 118, and/or one or more other components of the engine system 102 and/or the electric power source 202 may include one or more devices 300 and/or one or more components of the device 300. As shown in FIG. 3, the device 300 may include a bus 310, a processor 320, a memory 330, an input component 340, an output component 350, and/or a communication component 360.

The bus 310 may include one or more components that enable wired and/or wireless communication among the components of the device 300. The bus 310 may couple together two or more components of FIG. 3, such as via operative coupling, communicative coupling, electronic coupling, and/or electric coupling. For example, the bus 310 may include an electrical connection (e.g., a wire, a trace, and/or a lead) and/or a wireless bus. The processor 320 may include a central processing unit, a graphics processing unit, a microprocessor, a controller, a microcontroller, a digital signal processor, a field-programmable gate array, an application-specific integrated circuit, and/or another type of processing component. The processor 320 may be implemented in hardware, firmware, or a combination of hardware and software. In some implementations, the processor 320 may include one or more processors capable of being programmed to perform one or more operations or processes described elsewhere herein.

The memory 330 may include volatile and/or nonvolatile memory. For example, the memory 330 may include random access memory (RAM), read only memory (ROM), a hard disk drive, and/or another type of memory (e.g., a flash memory, a magnetic memory, and/or an optical memory). The memory 330 may include internal memory (e.g., RAM, ROM, or a hard disk drive) and/or removable memory (e.g., removable via a universal serial bus connection). The memory 330 may be a non-transitory computer-readable medium. The memory 330 may store information, one or more instructions, and/or software (e.g., one or more software applications) related to the operation of the device 300. In some implementations, the memory 330 may include one or more memories that are coupled (e.g., communicatively coupled) to one or more processors (e.g., processor 320), such as via the bus 310. Communicative coupling between a processor 320 and a memory 330 may enable the processor 320 to read and/or process information stored in the memory 330 and/or to store information in the memory 330.

The input component 340 may enable the device 300 to receive input, such as user input and/or sensed input. For example, the input component 340 may include a touch screen, a keyboard, a keypad, a mouse, a button, a microphone, a switch, a sensor, a global positioning system sensor, an accelerometer, a gyroscope, and/or an actuator. The output component 350 may enable the device 300 to provide output, such as via a display, a speaker, and/or a light-emitting diode. The communication component 360 may enable the device 300 to communicate with other devices via a wired connection and/or a wireless connection. For example, the communication component 360 may include a receiver, a transmitter, a transceiver, a modem, a network interface card, and/or an antenna.

The device 300 may perform one or more operations or processes described herein. For example, a non-transitory computer-readable medium (e.g., memory 330) may store a set of instructions (e.g., one or more instructions or code) for execution by the processor 320. The processor 320 may execute the set of instructions to perform one or more operations or processes described herein. In some implementations, execution of the set of instructions, by one or more processors 320, causes the one or more processors 320 and/or the device 300 to perform one or more operations or processes described herein. In some implementations, hardwired circuitry may be used instead of or in combination with the instructions to perform one or more operations or processes described herein. Additionally, or alternatively, the processor 320 may be configured to perform one or more operations or processes described herein. Thus, implementations described herein are not limited to any specific combination of hardware circuitry and software.

The number and arrangement of components shown in FIG. 3 are provided as an example. The device 300 may include additional components, fewer components, different components, or differently arranged components than those shown in FIG. 3. Additionally, or alternatively, a set of components (e.g., one or more components) of the device 300 may perform one or more functions described as being performed by another set of components of the device 300.

Figure 4:
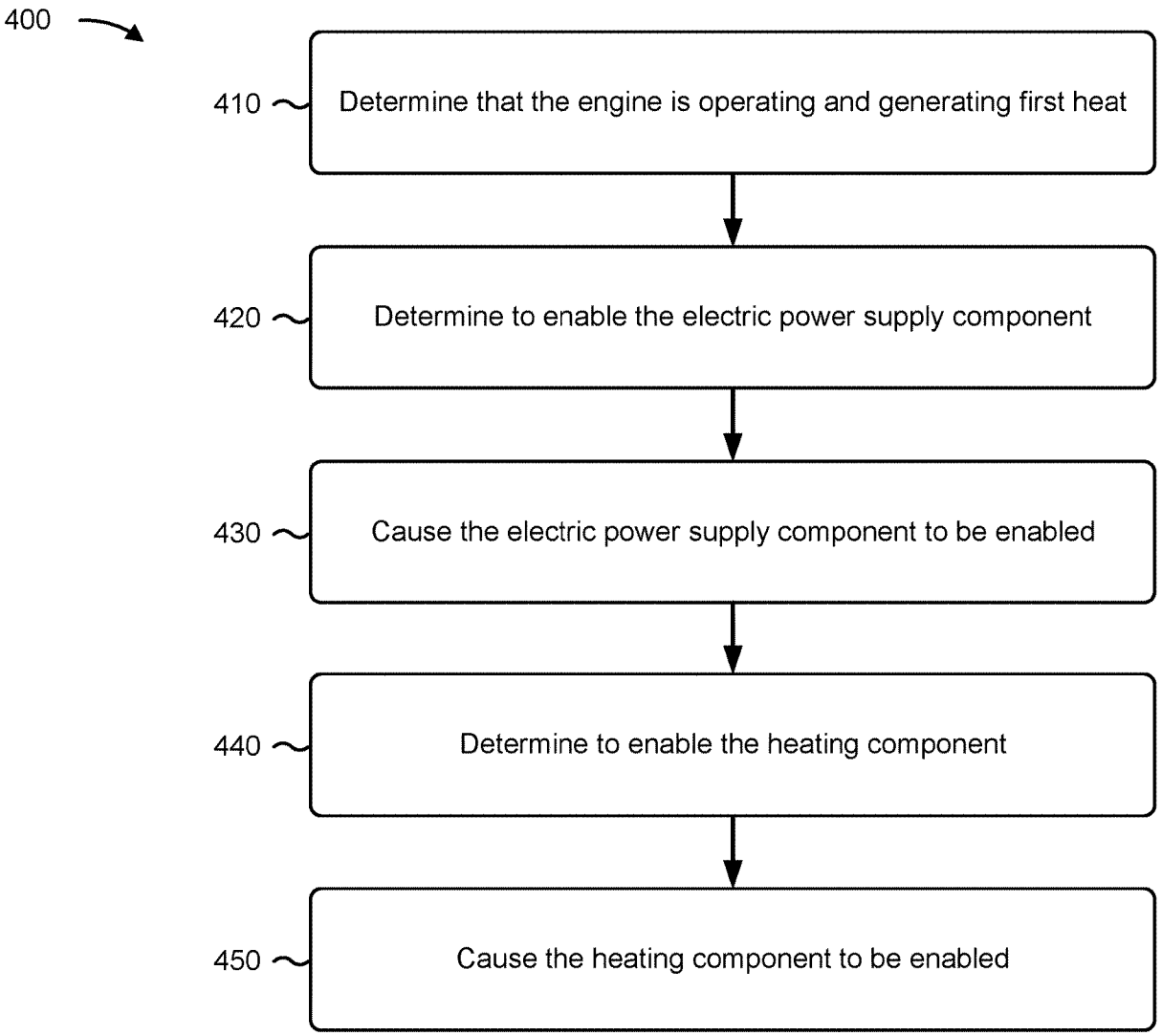
FIG. 4 is a flowchart of an example process associated with reducing methane emissions associated with a lean-burn natural gas engine.

FIG. 4 is a flowchart of an example process 400 associated with reducing methane emissions associated with a lean-burn natural gas engine. One or more process blocks of FIG. 4 may be performed by a controller (e.g., the controller 116). One or more process blocks of FIG. 4 may be performed by another device or a group of devices separate from or including the controller, such as one or more components of an engine system (e.g., the engine system 102), such as an engine (e.g., the engine 104), a cooling system (e.g., the cooling system 106), an electric power supply component (e.g., the electric power supply component 108), a heating component (e.g., the heating component 112), and/or one or more sensors (e.g., the one or more sensors 118). Additionally, or alternatively, one or more process blocks of FIG. 4 may be performed by one or more components of device 300, such as processor 320, memory 330, input component 340, output component 350, and/or communication component 360.

As shown in FIG. 4, process 400 may include determining that the engine is operating and generating first heat (block 410). For example, the controller may determine that the engine is operating and generating first heat, as described above.

As further shown in FIG. 4, process 400 may include determining to enable the electric power supply component (block 420). For example, the controller may determine to enable the electric power supply component, as described above.

As further shown in FIG. 4, process 400 may include causing the electric power supply component to be enabled (block 430). For example, the controller may cause the electric power supply component to be enabled (e.g., to cause the electric power supply component to provide electric power to the heating component), as described above.

As further shown in FIG. 4, process 400 may include determining to enable the heating component (block 440). For example, the controller may determine to enable the heating component, as described above.

As further shown in FIG. 4, process 400 may include causing the heating component to be enabled (block 450). For example, the controller may cause the heating component to be enabled (e.g., to cause the heating component to generate and provide second heat within an aftertreatment housing and thereby enable a conversion process to reduce a percentage of methane in an exhaust gas generated by the engine), as described above.

Process 400 may include additional implementations, such as any single implementation or any combination of implementations described in connection with one or more other processes described elsewhere herein.

Although FIG. 4 shows example blocks of process 400, in some implementations, process 400 may include additional blocks, fewer blocks, different blocks, or differently arranged blocks than those depicted in FIG. 4. Additionally, or alternatively, two or more of the blocks of process 400 may be performed in parallel.

INDUSTRIAL APPLICABILITY

Some implementations described herein provide an engine system that includes a lean-burn natural gas engine, an electric power supply component, an aftertreatment housing, and a heating component within the aftertreatment housing. The electric power supply component is configured to provide electric power to the heating component, which generates heat within the aftertreatment housing to enable a conversion process to reduce an amount of methane in an exhaust gas produced by the lean-burn natural gas engine. The electric power supply component may generate the electric power using heat generated by the lean-burn natural gas engine (that is provided to the electric power supply component by the lean-burn natural gas engine and/or a cooling system configured to draw the heat from the lean-burn natural gas engine). Additionally, or alternatively, the electric power supply component may obtain the electric power from an electric power source that generates the electric power using one or more low-carbon generation techniques (e.g., that do not require the combustion of fossil fuels or other high-carbon fuels).

In this way, some implementations described herein enable a conversion process that reduces methane emissions of an exhaust gas of a lean-burn natural gas engine. Such a conversion is not practically possible for typical lean-burn natural gas engines that produce low temperature exhaust gas (e.g., that is not hot enough to react with a catalyst). Further, by using the lean-burn natural gas engine's own heat and/or other low-carbon generation techniques to produce the electric power that is used by the heating component to generate heat that enables the conversion process, other unwanted emissions (e.g., NOx emissions) are prevented or reduced.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A system, comprising:

a lean-burn natural gas engine;

an electric power supply component that includes one or more of one or more thermoelectric generators, one or more batteries, one or more battery packs, one or more battery strings, one or more battery modules, or one or more battery cells; and an aftertreatment housing including:

a catalyst, and a heating component that includes an electrically driven heater, wherein:

the lean-burn natural gas engine is configured to provide, when in operation, an exhaust gas to an input end of the aftertreatment housing, the aftertreatment housing is configured to allow the exhaust gas to flow through the aftertreatment housing from the input end of the aftertreatment housing to an output end of the aftertreatment housing, the electric power supply component is configured to provide, to the heating component, electric power that is generated using one or more low-carbon generation techniques, and a controller is configured to:

when the electric power supply component is not actively providing the electric power to the heating component, determine a state of charge (SoC) for the electric power supply component;

one of:

cause, when the SoC satisfies a threshold, the electric power supply component to be enabled to operate and provide the electric power to the heating component, or cause, when the SoC does not satisfy the threshold, the electric power supply component to be disabled from providing the electric power to the heating component; and cause the heating component to provide, based on the electric power actively provided by the electric power supply component, heat within the aftertreatment housing to cause a temperature associated with an internal environment of the aftertreatment housing to satisfy a temperature threshold associated with enabling a conversion process that reduces methane emissions within the exhaust gas.

2. The system of claim 1, wherein:

a percentage of methane in the exhaust gas after the exhaust gas exits the aftertreatment housing via the output end of the aftertreatment housing is less than a percentage of methane in the exhaust gas before the exhaust gas enters the aftertreatment housing via the input end of the aftertreatment housing.

3. The system of claim 1, wherein the temperature associated with the internal environment of the aftertreatment housing satisfies the temperature threshold when the temperature associated with the internal environment of the aftertreatment housing is greater than or equal to 500 degrees Celsius.

4. The system of claim 1, wherein the temperature associated with the internal environment of the aftertreatment housing is at least one of:

a temperature associated with the exhaust gas within the aftertreatment housing, or a temperature associated with the catalyst of the aftertreatment housing.

5. The system of claim 1, wherein the lean-burn natural gas engine generates first heat as a result of the operation of the lean-burn natural gas engine, and the heat provided by the heating component is a second heat, and wherein the electric power supply component is configured to:

generate, using a thermoelectric generation technique and based on the first heat, the electric power.

6. The system of claim 5, wherein the first heat is provided to the electric power supply component via a cooling system associated with the lean-burn natural gas engine.

7. The system of claim 5, wherein a first temperature associated with the first heat is less than a second temperature associated with the second heat.

8. The system of claim 1, wherein the electric power supply component includes the one or more batteries.

9. The system of claim 1, wherein the one or more low-carbon generation techniques include at least one of:
a thermoelectric generation technique;
a hydroelectric generation technique;
a wind power generation technique;
a solar power generation technique;
a geothermal power generation technique; or
a nuclear power generation technique.

10. A system, comprising:
a controller;
an electric power supply component;
an aftertreatment housing; and
a heating component within the aftertreatment housing, wherein:
the heating component includes an electrically driven heater,
the aftertreatment housing is configured to allow exhaust gas, generated by a lean-burn natural gas engine, to flow through the aftertreatment housing from an input end of the aftertreatment housing to an output end of the aftertreatment housing,
the electric power supply component is configured to provide, to the heating component, electric power that is generated using one or more low-carbon generation techniques; and
the controller is configured to:
when the electric power supply component is not actively providing the electric power to the heating component, determine a state of charge (SoC) for the electric power supply component;
at least one of:
cause, when the SoC satisfies a threshold, the electric power supply component to be enabled to operate and provide the electric power to the heating component, or
cause, when the SoC does not satisfy the threshold, the electric power supply component to be disabled from providing the electric power to the heating component; and
cause the heating component to provide, based on the electric power actively provided by the electric power supply component, heat within the aftertreatment housing to cause a temperature associated with an internal environment of the aftertreatment housing to satisfy a temperature threshold associated with enabling a conversion process that reduces methane emissions within the exhaust gas.

11. The system of claim 10, wherein:
a percentage of methane in the exhaust gas after the exhaust gas exits the aftertreatment housing via the output end of the aftertreatment housing is less than a percentage of methane in the exhaust gas before the exhaust gas enters the aftertreatment housing via the input end of the aftertreatment housing.

12. The system of claim 10, wherein the electric power supply component is configured to generate, using a thermoelectric generation technique, the electric power based on other heat generated as a result of generation of the exhaust gas by the lean-burn natural gas engine.

13. The system of claim 12, wherein the electric power supply component is configured to obtain the other heat via a cooling system associated with the lean-burn natural gas engine.

14. The system of claim 10, wherein the electric power supply component includes at least one of:
one or more thermoelectric generators, or
one or more batteries.

15. A system, comprising:
an electric power supply component; and
a heating component within an aftertreatment housing, wherein:
the heating component includes an electrically driven heater,
the electric power supply component is configured to provide, to the heating component, electric power that is generated using one or more low-carbon generation techniques,
a controller is configured to:
when the electric power supply component is not actively providing the electric power to the heating component, determine a state of charge (SoC) for the electric power supply component;
at least one of:
cause, when the SoC satisfies a threshold, the electric power supply component to be enabled to operate and provide the electric power to the heating component, or
cause, when the SoC does not satisfy the threshold, the electric power supply component to be disabled from providing the electric power to the heating component; and
cause the heating component to provide, based on the electric power actively provided by the electric power supply component, heat within the aftertreatment housing to cause a temperature associated with an internal environment of the aftertreatment housing to satisfy a temperature threshold associated with enabling a conversion process that reduces methane emissions within exhaust gas, and
the exhaust gas is generated by a lean-burn natural gas engine.

16. The system of claim 15, wherein the electric power supply component includes at least one of:
one or more thermoelectric generators, or
one or more batteries.

17. The system of claim 15, wherein the electric power supply component is configured to generate the electric power based on other heat generated as a result of generation of the exhaust gas by the lean-burn natural gas engine.

18. The system of claim 17, wherein the electric power supply component is configured to obtain the other heat via a cooling system associated with the lean-burn natural gas engine.

19. The system of claim 15,
wherein the electric power supply component includes one or more batteries, and
wherein the SoC is a SoC of the one or more batteries.

20. The system of claim 15,
wherein the threshold is a battery charge percentage threshold, and
wherein the controller is further configured to:
determine that the electric power supply component is to be enabled based on the SoC satisfying the battery charge percentage threshold.

* * * * *